US006691896B2

(12) United States Patent
Meshberg

(10) Patent No.: US 6,691,896 B2
(45) Date of Patent: Feb. 17, 2004

(54) SAFETY CLOSURE FOR A CONTAINER

(75) Inventor: Philip Meshberg, Boynton Beach, FL (US)

(73) Assignee: Dispensing Patents International, LLC, Boynton Beach, FL (US)

( * ) Notice: Subject to any disclaimer, the term of this patent is extended or adjusted under 35 U.S.C. 154(b) by 0 days.

(21) Appl. No.: 09/933,011

(22) Filed: Aug. 21, 2001

(65) Prior Publication Data

US 2003/0038146 A1 Feb. 27, 2003

(51) Int. Cl.[7] ..... B67B 5/00
(52) U.S. Cl. ..... 222/153.13; 222/402.11
(58) Field of Search ..... 222/153.11, 153.13, 222/402.11

(56) References Cited

U.S. PATENT DOCUMENTS 3,422,996 A * 1/1969 Lipman ..... 222/402.11
3,848,778 A * 11/1974 Meshberg ..... 222/402.11
4,773,567 A * 9/1988 Stoody ..... 222/153.11
5,379,924 A * 1/1995 Taylor ..... 222/402.11

* cited by examiner

*Primary Examiner*—Michael Mar
*Assistant Examiner*—Melvin A. Cartagena
(74) *Attorney, Agent, or Firm*—Kenyon & Kenyon

(57) ABSTRACT

An embodiment of a safety closure for a container includes a sleeve which is fixed to the container inside of which a part is rotatable to place the container in a position where dispensing may take place. A recess in the sleeve with a vertical wall cooperates with an outwardly biased hinged tab on the rotatable part abutting the wall and preventing rotation, unless the tab is pushed in to clear the wall, while at the same time rotating the first part to said dispensing position.

23 Claims, 6 Drawing Sheets

SAFETY CLOSURE FOR A CONTAINER

BACKGROUND OF THE INVENTION

The present invention relates to containers in general and more particularly to a safety closure for a container which requires two handed operation to place the container in a condition where dispensing of product becomes possible.

U.S. Pat. No. 5,593,064, the disclosure of which is hereby incorporated by reference in its entirety, discloses a promotional dispensing package which is easily shipped, filled and assembled is disclosed. The package includes a retaining opening into which a modular pump is snap-fit by inserting the modular pump through an open end of the package. The package also includes a upstanding wall, which provides a dispensing actuator locking and sealing mechanism, as well as a tamper-evident tab. The package and pump are assembled at a production site, and are thereafter shipped to a filling site with a bottom. The package is filled through the open bottom end, and then the bottom is sealingly affixed to the package. Accordingly, the device can be filled and finally assembled with a minimal number of steps, and is therefore particularly suited for quick-turnaround marketing.

Although the package includes a dispensing actuator locking and sealing mechanism, as well as a tamper-evident tab, it is not childproof. That is, it is relatively easy, by rotation, to unlock the actuator and dispense material. In some cases the package might be used, for example, for a breath freshener and spraying in the mouth expected. However, the package might also contain insect repellant, sun tan lotion, or another product which is toxic if ingested. Particularly in view of these multiple uses, a young child could pick up a dispenser containing a toxic material and ingest it.

The danger in other types of containers such as medicine bottles and containers for household chemicals, that a child might open and ingest a harmful substance is well know.

SUMMARY OF THE INVENTION

An embodiment of a safety closure for a container includes a sleeve which is fixed to the container inside of which a part is rotatable to place the container in a position where dispensing may take place. A recess in the sleeve with a vertical wall cooperates with an outwardly biased hinged tab on the rotatable part abutting the wall and preventing rotation, unless the tab is pushed in to clear the wall, while at the same time rotating the first part to said dispensing position.

The application of the safety closure to an embodiment of a container which is a dispensing package with an actuator with a spay nozzle is illustrated.

DETAILED DESCRIPTION OF THE INVENTION

Figure 1:
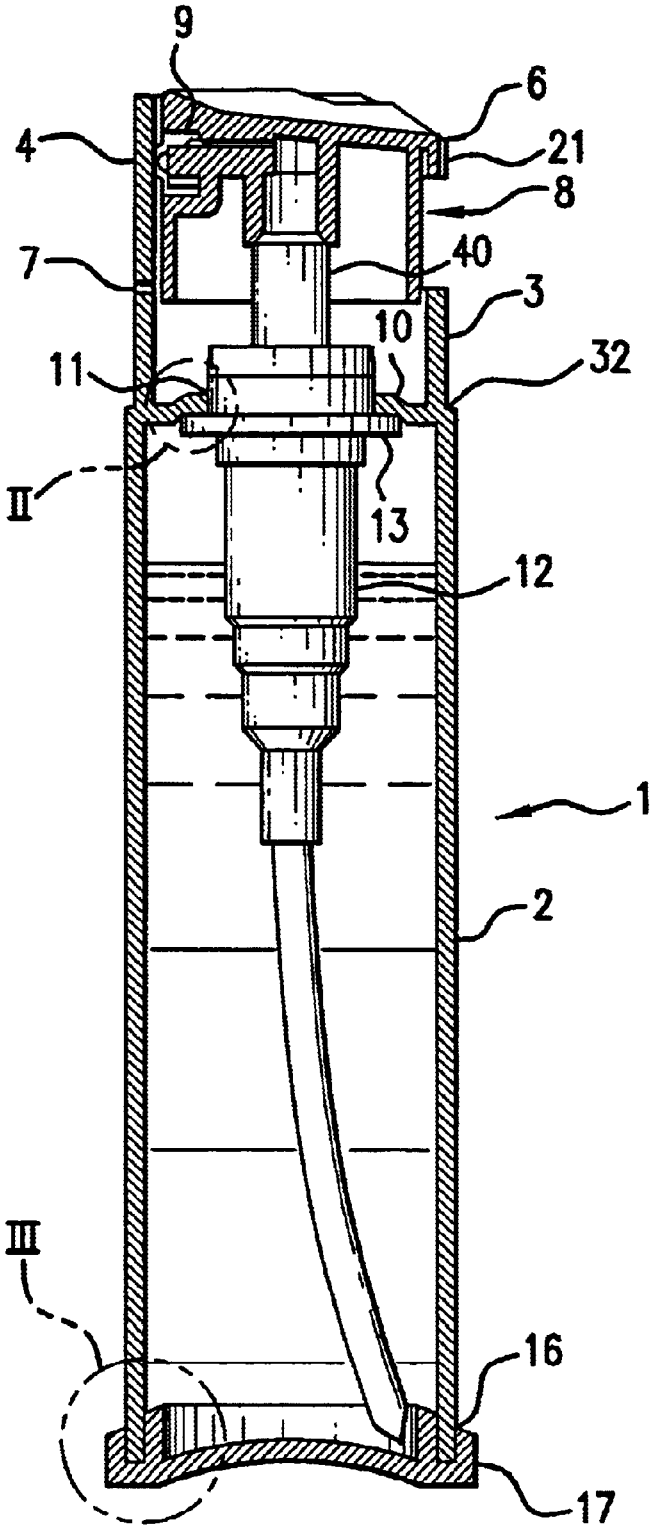
FIG. 1 is a cross-sectional view of a dispenser with which the present invention may be used.

An embodiment of a dispenser with which the present invention may be used is shown in cross-sectional view, in a sealed condition, in FIG. 1. The dispenser includes a package 1 which includes a container 2 and an upstanding wall 3 forming a sleeve. Upstanding wall 3 includes a tamper evident tab 4, connected to the upstanding wall 3 by a snap-away or tear-away joint 7. Joint 7 is originally molded to integrally connect tab 4 to upstanding wall 3, but is designed to be of sufficient thinness so that an end user can ultimately break the joint 7 so that the tab 4 can be removed from sleeve 3 to uncover nozzle 9 on actuator 6 when it is desired to first use the dispenser 1. Upstanding wall 3 can include a recess 8 intended to facilitate movement of an actuator nozzle 9 within the upstanding wall 3. Although shown as being vertically oriented in FIG. 1, tab 4 could also be oriented in a horizontal direction, with the joint 7 being disposed vertically at one end of the tab 4.

Container 2 and upstanding wall 3 are separated by a retaining wall 10 which includes a retaining opening 11 used to secure a pump 12 in the package 1. Pump 12 can be of any conventional design. Pump 12 includes a retention flange 13 for limiting the amount of inward movement of the pump 12 into the container 1 and for providing a surface for an energy director 15 to adhere during a process of sonic or ultrasonic welding. Alternatively, pump could include a retention groove which retains the pump 12 in the package 1 via a snap-fit engagement with retaining wall 10. Pump 12 is inserted into retaining opening 11 through the lower end 16 of container 2 or from the upper end including the upstanding wall 3, which is initially open. Pump 12 has a projecting stem 40 on the end of which actuator 6 is mounted.

Figure 2:
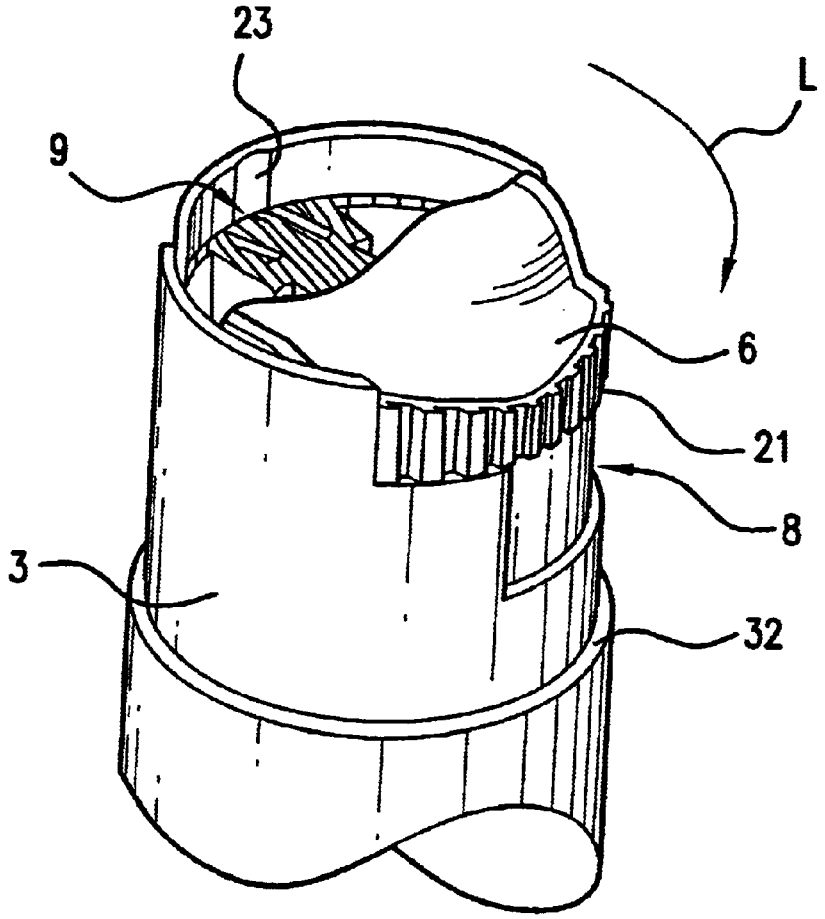
FIGS. 2–4 are perspective views of an actuator and locking mechanisms, wherein FIG. 4 includes a partial cross-sectional view.
Figure 4:
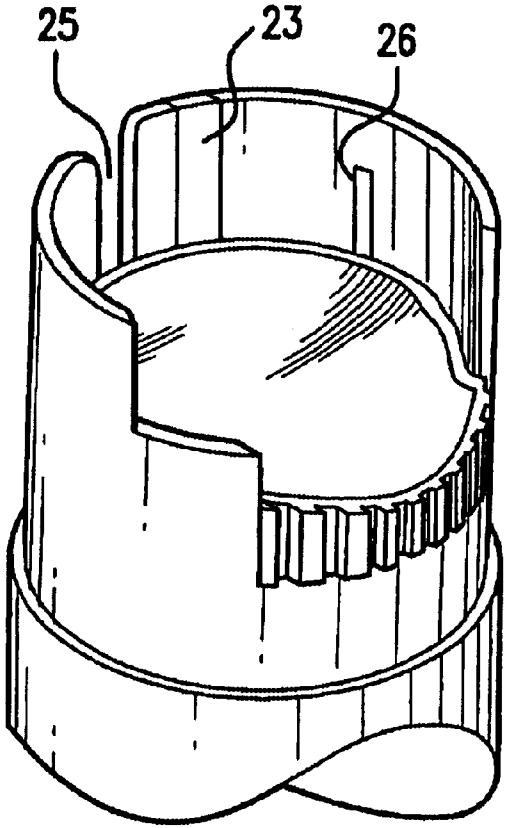
Figure 3:
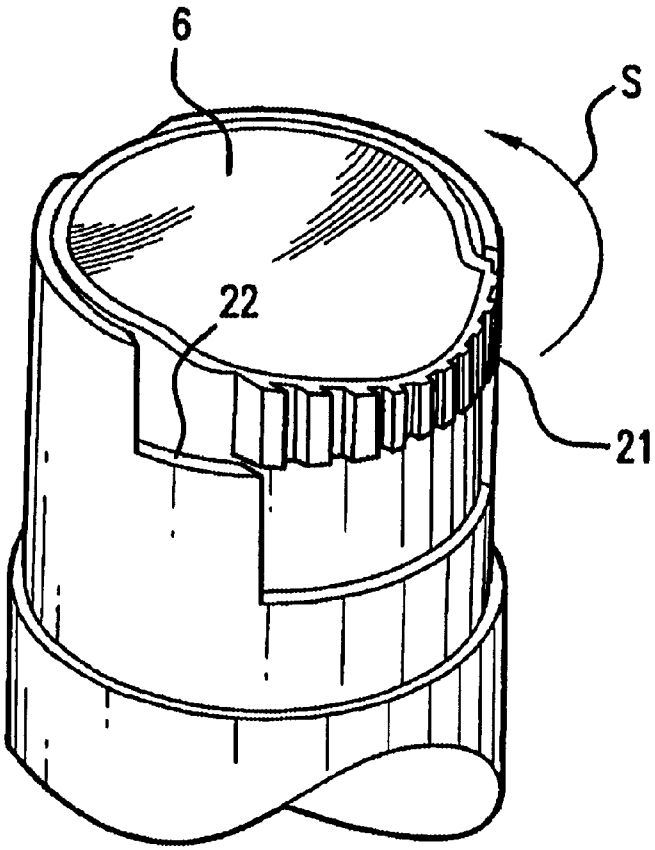

FIGS. 2–4 show the particular features of the actuator 6 of the dispenser, and the particular locking and retaining features of the upstanding wall 3. In FIG. 2, the forward of actuator 6 is shown in cross-sectional view, to show the manner in which the nozzle 9 is sealed in a non-dispensing position. Actuator 6 includes a projecting 21 which is used to rotate actuator 6 from a dispensing to a non-dispensing position, and which also acts to prevent downward movement of actuator 6 when actuator 6 is in a non-dispensing position. Upstanding wall 3 includes a limit stop 22 which prevents actuator 6 from moving downward—and thus dispensing material from pump 12—via engagement with limit stop 22 (See FIG. 2). The position of the actuator 6 shown in FIG. 2 is the position in which the actuator 6 is kept before the tab 4 is remove from upstanding wall 3. In this position, nozzle 9, which includes a slightly projecting tip, is snapped into a vertical groove 23. Groove 23 acts to retain nozzle 9 and actuator 6 in a non-dispensing position, and also seals the nozzle 9 against the incursion of air into the nozzle 9 orifice.

Rotating actuator 6 in the direction indicated by arrow S places the actuator 6 and nozzle 9 into a spraying or dispensing position. In the actuator as disclosed in U.S. Pat. No. 5,593,064, there was nothing to prevent this rotation. Thus, it could be done by a young child. In the dispensing position (shown in FIGS. 3 and 4) projecting 21 is in alignment with recess 8. In this position, nozzle 9 is aligned with opening 25 which is formed when tab 4 is removed. As seen by comparing FIGS. 3 and 4, projecting 21 travels within recess 8 upon downward actuation of actuator 6, allowing dispensing of material through nozzle 9 via pump 12. Rotating actuator 6 in the direction indicated by arrow L into a locking position, in which nozzle 9 is snapped into groove 23. Indication that nozzle 9 is properly in a non-dispensing position can be provided via a bead 26, which can coact with a bead on the outer circumferential surface of actuator 6, thereby providing an audible "snapping" sound when the beads slide over one another.

Figure 5:
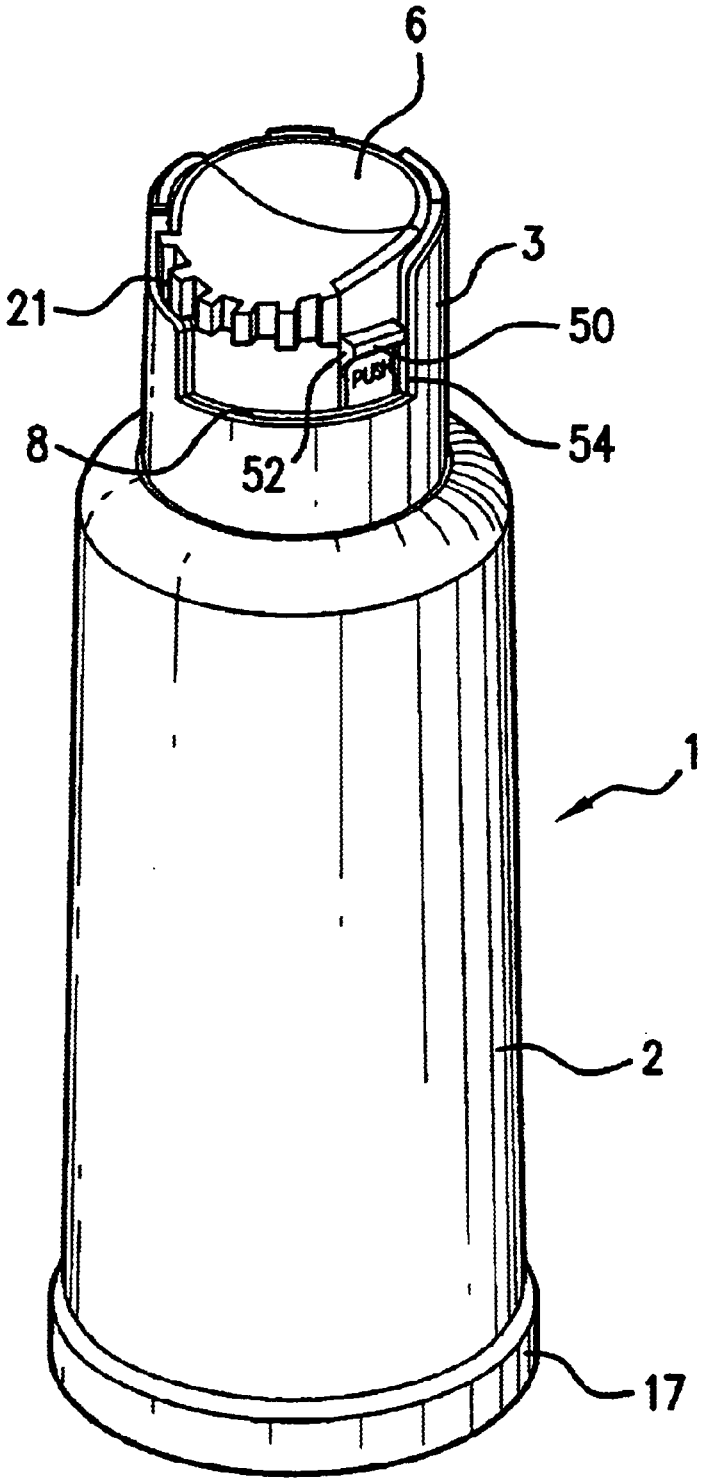
FIG. 5 is a rear perspective view of the dispenser with the safety tab of the present invention installed.

FIG. 5 is a rear perspective view of the package 1 of FIG. 1 in which the safety lock of the present invention is incorporated. Visible is the actuator 6 in sleeve 3. As noted above, the actuator must be rotated to align projection 21 with recess 8. However, in accordance with the present invention, a safety tab 50 is formed in actuator 6 and has a projecting lip 52 which abuts a vertical wall 54 of recess 8 and prevents rotation. The tab 50 is hinged at its base and biased outwardly. To carry out rotation, one must push in on the tab 50 until the lip 52 clears the wall 54, while at the same time rotating the actuator. This is a two handed operation which is difficult for a small child to perform.

Figure 6:
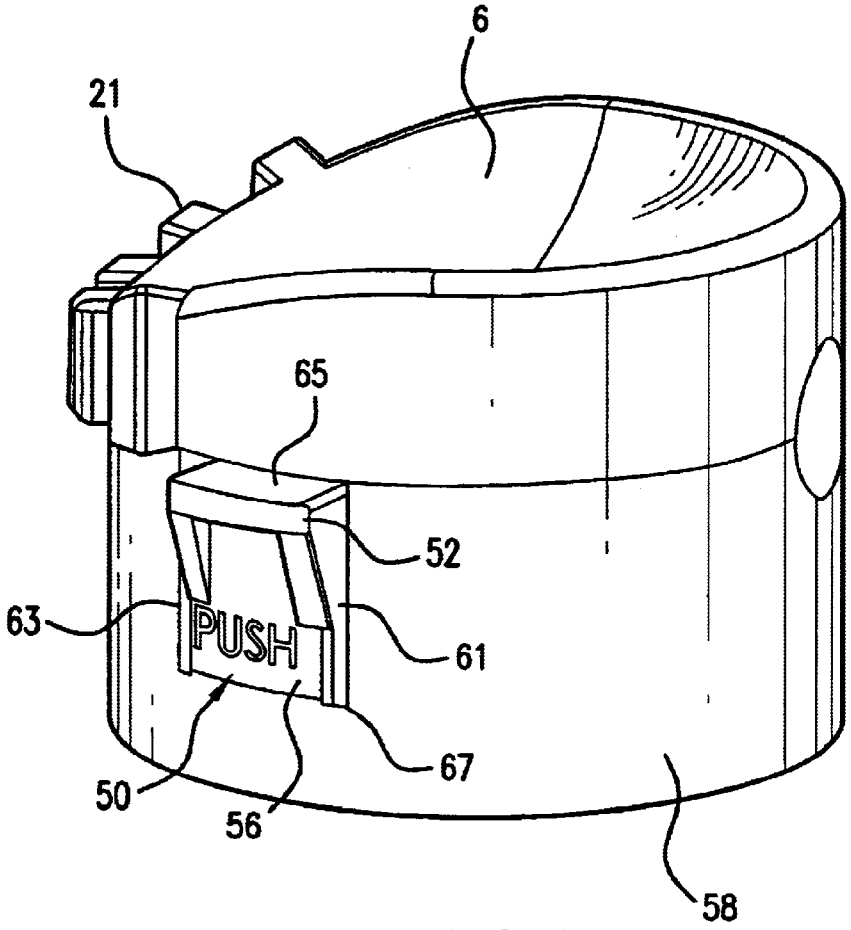
FIG. 6 is a perspective view of the actuator of the dispenser with the safety tab of the present invention.

FIG. 6 is a perspective view of actuator 6. In the illustrated embodiment, the tab 50 is molded in the wall 58 of the actuator 6. The base 56 of tab 50 is just a of wall 58. At the upper end of tab 50, the projecting lip 52 is formed. Vertical slits 61 and 63 and horizontal slit 65, extending through wall 58, separate tab 50 from the rest of the wall 58. Thus, by pushing in on the projecting lip 52, it can be forced to rotate about its base 67 which acts as a hinge. The fact that is an integral part of wall 58 insures that the projecting lip is biased outwardly. Although this is a simple way to form the biased hinged tab, other arrangement with different types of hinges and different forms of biasing may equally well be used.

The method of using the illustrated embodiment is as follows. The container 2 is molded as an integral unit with upstanding wall 3 and retaining wall 10. Container 2 is inverted, and may be inserted into a holding or restraining mechanism which interacts with shoulder 32 to restrain container 2 in an inverted position. Next, pump 12 is inserted into either the open end of lower end 16 or upper end including upstanding wall 3, so that the upper of pump 12 fits through retaining opening 11 until flange 13 abuts retaining wall 10. Actuator 6, with tab 50 formed therein, can then be inserted onto the outlet stem 40 of pump 12.

The container 2 thus assembled is shipped together with bottom 17 in an unassembled condition to a filling and assembly location where it may be filled and labeled and shipped to an end user.

Upon receiving package 1, the customer breaks off tab 4, and then when dispensing is desired, rotates actuator 6 to the position shown in FIG. 5. To do this, as noted above, it is necessary to first press in on tab 50 until it clears wall 54 of recess 8, while at the same carrying out a rotation. Downward actuation of actuator 6 dispenses liquid product from package 1, through nozzle 9. Upon completion of actuation, the actuator 6 is rotated back to the position shown in FIG. 5 and tab 50 snaps back in the position where the actuator can not be rotated without pushing it in again.

Figure 7:
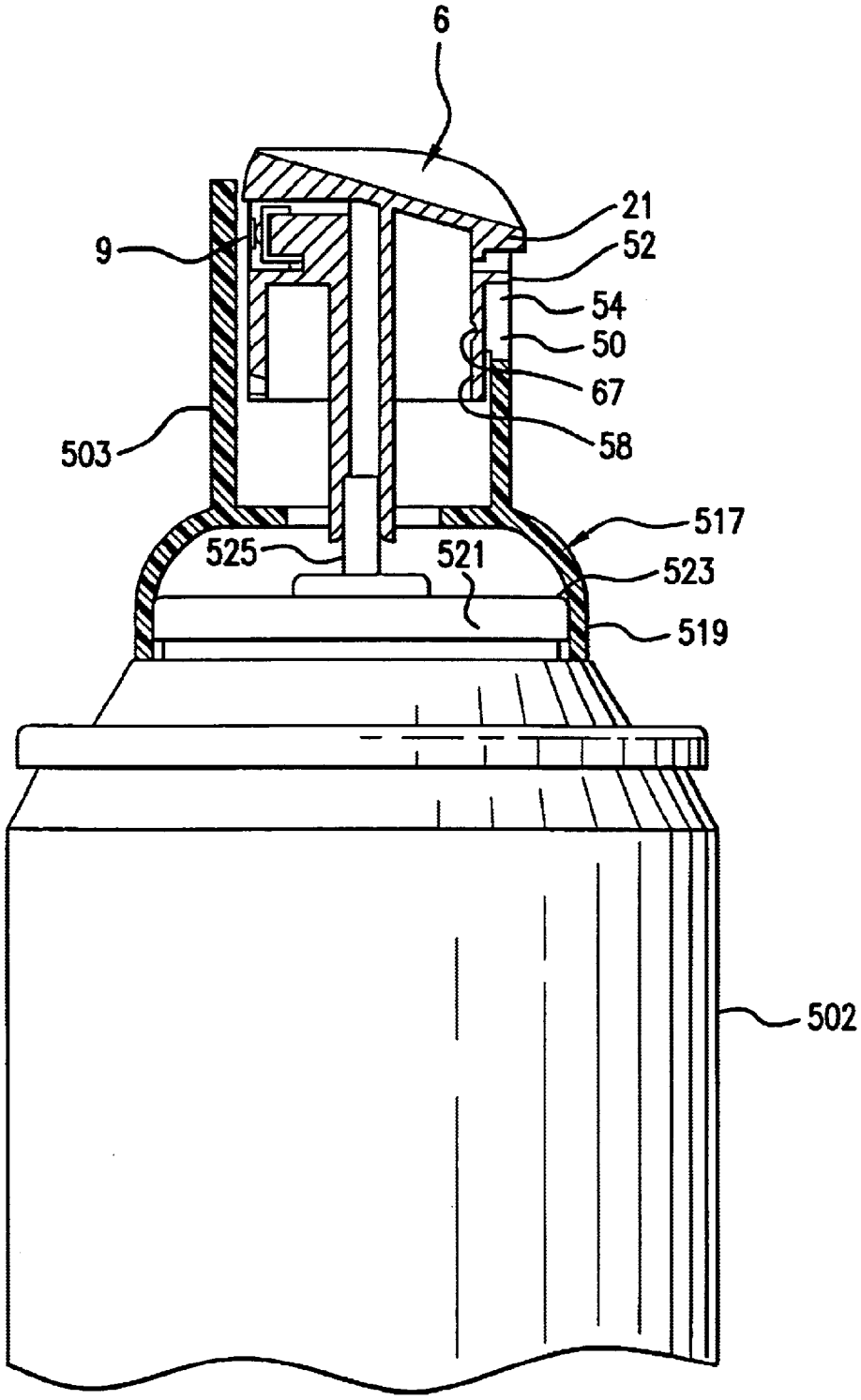
FIG. 7 is a crossectional view of an embodiment of the safety device of the present invention mounted on an aerosol dispenser.

The embodiment of FIG. 1 is directed to a pump. However, the actuators with spray nozzles described herein may also be used with aerosol valves. A specific example of an embodiment of the present invention used with an aerosol valve is shown in FIG. 7, which shows an aerosol container 502 with a mounting cap 517 which includes an embodiment of the nozzle closure of the present invention of the general nature shown in FIGS. 2–6. The mounting cap 517 shown in FIG. 7 includes a cylindrical skirt 519 which engages a beaded rim 523 of a mounting cup 521, at the top of the aerosol container 502, with a press fit, attaching mounting cap 517, and with its upstanding wall 503, to container 502. The mounting cap can also or alternatively be designed with a bead on its end, which will allow it to snap over the beaded rim 523. Wall 503 is constructed in a manner similar to wall or sleeve 3 of the previously explained embodiments. Container 502 includes, at its upper end, a beaded rim 523 extending around its entire circumference. In conventional fashion, this is part of mounting cup 521. Mounting cup 521 contains an aerosol valve and has as its purpose mounting the aerosol valve to the top of container 502. A stem 525 for actuating the aerosol valve projects from the aerosol valve in conventional fashion. Actuator 6 is pressed onto the projecting stem to permit actuating the valve and dispensing material through nozzle 9.

The construction and operation of safety lock of the present invention is as explained above. The cross-sectional view of FIG. 7 shows tab 50 with projecting lip 52 abutting against wall 54. Base 67 of the tab 50 is a thinner section of the wall to act as a hinge. In the position shown, the dispensing outlet or nozzle 9 of the actuator 6 is behind wall 3 and dispensing is not possible. It is necessary to rotate actuator 6 to a position where nozzle 9 is aligned with an opening (not shown) such as the opening 25 of FIG. 4. In order to do this, the tab 50 must be pushed in, clear of the wall 54, and the actuator rotated at the same time, as described above, a difficult task for a small child.

In the embodiment of FIG. 1, the upstanding wall 3 is integral with the container. It will be recognized that just as the arrangement of the present invention can be added to a conventional aerosol dispenser, as illustrated in FIG. 7, it can also be added to an existing pump dispenser but providing a mounting cap which engages the body of the pump dispenser. These and other modifications can be made without departing from the spirit of the invention.

Furthermore, embodiments of the present invention has been described in the context of a liquid dispensing package. However, it is equally applicable to other types of packages, where a safety feature is need. Examples, include medicine bottles, containers for household chemical etc. All that is required is a sleeve attached to the container and within which a part (the actuator in the illustrated embodiment) is rotated place the container in a position where dispensing can take place. In the illustrated embodiment the actuator is pressed to spray a material. If the container contained liquid or powder to be poured, the rotation would result in removal or partial removal of a cap. The sleeve has a recess with a wall against which an outwardly biased hinged tab on the first part abuts and prevents rotation, unless the tab is pushed in to clear the wall, while at the same time rotating the first part into an open or dispensing position. These and other modifications can be made without departing from the spirit of the invention which is intended to be limited solely by the appended claims.

What is claimed is:

1. A safety closure for a container comprising:

a. a sleeve which is fixed to the container;

b. a part rotatable within the sleeve to place the container in a position where dispensing may take place;

c. a recess in the sleeve with a vertical wall; and d. a hinged tab having a projecting lip on the rotatable part abutting said wall and preventing rotation, unless the tab is pushed in so that the projecting lip clears the wall, while at the same time rotating the first part to said dispensing position.

2. A safety closure according to claim 1 wherein said tab includes a lower part which is part of a wall of said rotatable part, and an upper part containing the projecting lip abutting said wall.

3. A safety closure according to claim 2 wherein said tab including said projecting lip is integrally molded with said rotatable part and said tab is separated from said rotatable part by an upper and two side slits so as to form a bottom hinge about which said tab may rotate.

4. A dispensing package comprising:

a. a container;

b. an actuator including a nozzle;

c. an upstanding wall forming a sleeve in which said actuator may rotate attached to the container;

d. a recess formed in said the sleeve and having a vertical wall;

e. a hinged tab on the actuator biased outwardly and having a projecting lip abutting said wall and preventing rotation of said actuator from a rest position to a dispensing position, unless the tab is pushed in so that the projecting lip clears the wall, while at the same time rotating the first part to said dispensing position.

5. A safety closure according to claim 4 wherein said dispensing package is an aerosol dispenser.

6. A safety closure according to claim 5 wherein said upstanding wall is attached to the container with a mounting cap formed integrally with said upstanding wall.

7. A safety closure according to claim 4 wherein said upstanding wall is attached to the container with a mounting cap formed integrally with said upstanding wall.

8. A safety closure according to claim 4 wherein said dispensing package is a pump type dispenser.

9. A safety closure according to claim 8 wherein said upstanding wall is formed integrally with the container.

10. A safety closure according to claim 4 wherein said tab includes a lower part which is part of a wall of said actuator, and an upper part containing the projecting lip forming said portion abutting said wall.

11. A safety closure according to claim 10 wherein said tab including said projecting lip is integrally molded with said actuator and said tab is separated from said rotatable part by an upper and two side slits so as to form a bottom hinge about which said tab may rotate.

12. The dispensing package of claim 4, wherein:

said upstanding wall further includes a limit stop for preventing downward movement of an actuator, adjacent said recess.

13. The dispensing package of claim 12, and further including:

a projecting portion on said actuator overlying said limit stop when said actuator is in said rest position.

14. The dispensing package of claim 13 wherein:

said upstanding wall includes a removable tab covering a dispensing opening in said upstanding wall.

15. The dispensing package of claim 13 wherein:

said container and said upstanding wall are integrally formed.

16. The dispensing package of claim 13 wherein:

said container and upstanding wall are separated by a retaining wall which includes a retaining opening adapted to receive a pump.

17. The dispensing package of claim 13 and further including:

a pump inserted in said retaining opening.

18. The dispensing package of claim 12, wherein:

said upstanding wall includes a groove for retaining and sealing a nozzle on said actuator, said limit stop for preventing downward movement of said actuator when said nozzle is retained in said groove.

19. An attachment for a dispensing package comprising:

a. an actuator including a nozzle;

b. an upstanding wall forming a sleeve in which said actuator may rotate adapted to attach to a dispensing package container;

c. a recess formed in said the sleeve and having a vertical wall;

d. a hinged tab on the actuator biased outwardly and having a projecting lip abutting said wail and preventing rotation of said actuator from a rest position to a dispensing position, unless the tab is pushed in so that the projecting lip clears the wall, while at the same time rotating the first part to said dispensing position.

20. An attachment according to claim 19 wherein said dispensing package is an aerosol dispenser.

21. An attachment according to claim 20 wherein said mounting cap is adapted to be press fit onto the rim of a mounting cup of the aerosol dispenser.

22. An attachment according to claim 20 wherein said mounting cap is adapted to snap onto the rim of a mounting cup of the aerosol dispenser.

23. A safety closure according to claim 19 wherein said dispensing package is a pump type dispenser.

* * * * *